US005939368A

United States Patent [19]

Pamingle et al.

[11] Patent Number: 5,939,368

[45] Date of Patent: Aug. 17, 1999

[54] USE OF 1-METHOXY-2-METHYL-3-PHENYLPROPANE, 1-(2-METHOXYPROPYL)-4-METHYLBENZENE AND 3-METHOXY-2,2,3-TRIMETHYL-1-PHENYLBUTANE IN PERFUMERY

[75] Inventors: Hervé Pamingle, Versoix, Switzerland; Jean-Marc Gaudin, Annemasse, France

[73] Assignee: Firmenich SA, Geneva, Switzerland

[21] Appl. No.: 09/157,953

[22] Filed: Sep. 22, 1998

[30] Foreign Application Priority Data

Oct. 8, 1997 [CH] Switzerland ..... 2355/97

[51] Int. Cl.[6] ..... C11D 3/43; C11D 3/50

[52] U.S. Cl. ..... 510/102; 510/106; 512/8; 512/20; 512/21; 512/22; 568/700

[58] Field of Search ..... 510/102, 106; 512/8, 20, 21, 22; 568/700

[56] References Cited

U.S. PATENT DOCUMENTS 4,371,715 2/1983 Kiwala et al. ..... 568/659
5,248,434 9/1993 Nicholson ..... 252/95

FOREIGN PATENT DOCUMENTS 0 596 493 5/1994 European Pat. Off. .

*Primary Examiner*—Yogendra Gupta
*Assistant Examiner*—Gregory R. Delcotto
*Attorney, Agent, or Firm*—Pennie & Edmonds LLP

[57] ABSTRACT

The use of 1-methoxy-2-methyl-3-phenylpropane, 3-methoxy-2,2,3-trimethyl-1-phenylbutane or of 1-(2-methoxypropyl)-4-methylbenzene as perfuming ingredients is described. These two compounds possess an excellent stability in aggressive media and/or at high pH-values, which renders them very useful for application in chlorine bleach. The odor of these two compounds can be described as being of the green type with a nice, strong floral note.

11 Claims, No Drawings

USE OF 1-METHOXY-2-METHYL-3-PHENYLPROPANE, 1-(2-METHOXYPROPYL)-4-METHYLBENZENE AND 3-METHOXY-2,2,3-TRIMETHYL-1-PHENYLBUTANE IN PERFUMERY

TECHNICAL FIELD AND PRIOR ART

The present invention relates to the field of perfumery. It relates, more particularly, to the use of 1-methoxy-2-methyl-3-phenylpropane, 1-(2-methoxypropyl)-4-methylbenzene or of 3-methoxy-2,2,3-trimethyl-1-phenylbutane as perfuming ingredients.

A good number of compounds of analogous structure, which lend themselves to the use as perfuming ingredients, are known from the prior art. In this context, one can cite phenylethyl isopropyl ether, described in patent application EP-0 049 120, as well as phenylethyl methyl ether. These two compounds are very close in their olfactive notes, which can be described as being strongly green with a floral connotation and accompanied by a strong, rather musty, mushroom-earthy, side note.

One can also cite phenylethyl isoamyl ether, described in U.S. Pat. No. 5,248,434 and in patent application EP-0 596 493. This ether shows odor properties which are quite close to those of the two above-cited ethers, the green note, however, being even stronger and more aggressive. It also shows an earthy-green connotation evoking the green-earthy note of hyacinth.

Moreover, all these compounds were shown to be stable in chlorinated media. Such stability is a rare property and much looked for in perfuming ingredients intended to be used in typically aggressive media for perfumes such as, for example, detergents and chlorinated media. The problem of finding perfuming ingredients which are stable in such media thus continues to be of actuality.

DETAILED DESCRIPTION OF THE INVENTION

We have now discovered novel ethers which show a good stability in chlorinated media and which develop odor notes which are distinct from those of the known compounds, in particular with a more floral connotation and a more discrete green character.

The preferred compound of the invention is 1-methoxy-2-methyl-3-phenylpropane. Its odor shows a very natural rosy note of the rose leaf type. Moreover, a very pleasant undernote of the fruity-exotic type, evoking the odor of lychee, can be perceived. The odor of this ether is free from the moisty-earthy, mushroom type note which is found in the above-cited compounds and which is not appreciated as undernote in the type of functional perfumery applications for which these compounds are intended. Compared to the ethers cited which are known to be stable in chlorine bleach, 1-methoxy-2-methyl-3-phenylpropane is by far the most floral and rosiest, its odor being reminiscent of the odor of citronellol and geraniol. At the same time, its floral note is clearly softer and does not show the aggressive green note which is a common feature of the above cited known phenylethyl ethers, regarded as a drawback of this type of compounds suitable for use in oxidizing media. Finally, the fruity-exotic note of this novel compound brings a very original effect to the detergent applications, in particular in detergents with a high pH value, such as chlorine bleach.

1-Methoxy-2-methyl-3-phenylpropane is a compound known from the prior art. It has been described in Ind. J. Chem. 27B, 314 (1988), but no synthesis of this molecule is reported therein. Moreover, this reference does not mention or suggest the use of this molecule as perfuming ingredient.

The invention also relates to two other, novel compounds which are also appropriate to be used in chlorine bleach. One such compound is 1-(2-methoxypropyl)-4-methylbenzene which also shows a green note accompanied by a strong floral undernote. The fruity, exotic note is not present, however, but the compound shows an odor of aniseed and ethyl cinnamate, which are also quite appreciated novel notes in this type of application.

The other compound is 3-methoxy-2,2,3-trimethyl-1-phenylbutane, the odor of which can be described as being floral and fruity. The floral note is of the floral-animal type, showing connotations of the odor of indol and phenol, whereas the fruity note is of the citrus type, typical of grapefruit and nootkatone, strong and much appreciated.

The above-mentioned compounds show an excellent stability in chlorine bleach, as will be described in the examples below, and effectively cover the typical, aggressive and suffocating smell of chlorine bleach.

As is clear from the above, the compounds of the invention are particularly appropriate to be used in chlorine bleach and, more generally, in aggressive media and/or media having high pH-values. As examples, there can be cited detergents containing bleaching agents and activators such as, for example, tetraacethylethylenediamine (TAED), peroxygenated bleaching agents and, as is the case for chlorine bleach, hypochlorite, but also media containing reducing agents, as is the case in, for example, products for permanents. They are also useful in other applications in functional perfumery, and one can therefore cite applications in liquid or solid detergents for the treatment of textiles, fabric softeners, or yet detergent compositions or all-purpose household cleaners for the cleaning of dishes or various surfaces.

Of course, the use of the compounds of the invention is not limited to the above-mentioned products, they lend themselves to all other current uses in perfumery, namely the perfuming of soaps and shower gels, hygiene or hair-care products, as well as body deodorants, air fresheners or yet cosmetic preparations, and even for the use in fine perfumery, namely in perfumes and colognes.

In these applications, the compounds of the invention can be used alone or in admixture with other perfuming ingredients, solvents or adjuvants of current use in the art. The nature and the variety of these coingredients do not require a more detailed description here, which, moreover, would not be exhaustive, and the person skilled in the art will be able to choose the latter through its general knowledge and as a function of the nature of the product to be perfumed and of the desired olfactive effect.

These perfuming ingredients belong to chemical classes as varied as alcohols, aldehydes, ketones, esters, ethers, acetates, nitrites, terpene hydrocarbons, sulfur- and nitrogen-containing heterocyclic compounds, as well as essential oils of natural or synthetic origin. A large number of these ingredients is moreover listed in reference textbooks such as the book of S. Arctander, Perfume and Flavor Chemicals, 1969, Montclair, N.J., USA, or its more recent versions, or in other works of similar nature.

The proportions in which the compounds according to the invention can be incorporated in the various products mentioned beforehand vary within a large range of values. These values depend on the nature of the article or product that one desires to perfume and the odor effect searched for, as well as on the nature of the coingredients in a given composition when the compounds of the invention are used in admixture with perfuming coingredients, solvents or adjuvants of current use in the art.

As an example, there can be cited typical concentrations of the order of 0.1 to 10%, or even up to 20%, by weight of these compounds relative to the weight of the perfuming composition in which they are incorporated. Far lower concentrations than those mentioned above can be used when the compounds are directly applied for perfuming the various consumer products cited beforehand.

The compounds of the present invention can be synthesized as will be described hereinafter.

In order to obtain 1-methoxy-2-methyl-3-phenylpropane (see line (1) of the scheme below), we start from methylcinnamic aldehyde which, in the first stage of the synthesis, is hydrogenated to 1-hydroxy-2-methyl-3-phenylpropane with an appropriate catalyst, for example Raney-nickel. The product obtained is then etherified using a current etherifying agent like, for example, the system $MH/CH_3X$ in which X is a halogen atom and M is an alkali metal, in order to obtain the desired product.

The synthesis used for the production of 1-(2-methoxypropyl)-4-methylbenzene (see line (2) of the scheme below) employs 3-bromotoluene as starting agent, which is reacted with propylene oxide after having been converted into the corresponding Grignard type compound. The thus-obtained 1-(2-hydroxypropyl)-4-methylbenzene is then etherified to the final product with an etherifying agent, as specified above.

Finally, 3-methoxy-2,2,3-trimethyl-1-phenylbutane (see line (3) of the scheme below) is prepared from 3,3-dimethyl-4-phenyl-2-butanone which is reacted with a methyl magnesium halide, e.g. the bromide or iodide, to obtain 2,3,3-trimethyl-4-phenyl-2-butanol. As in the synthesis described above for the other compounds of the invention, this alcohol is then etherified to obtain the desired product.

(1)

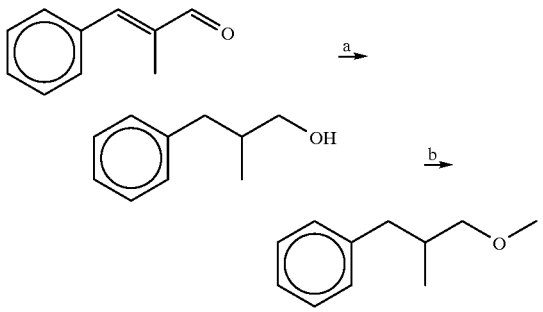

(2)

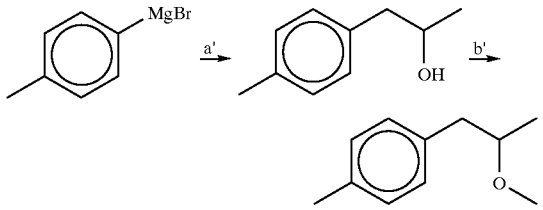

-continued (3)

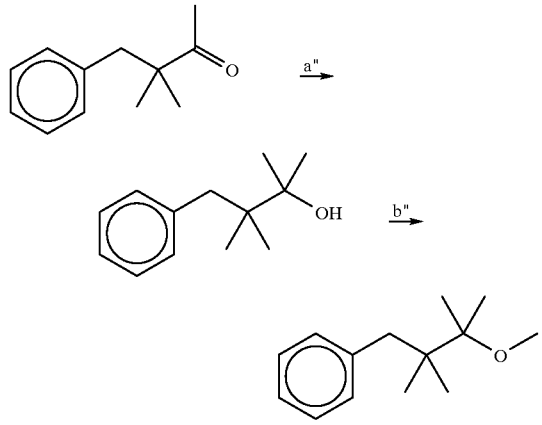

a:$H_2$/catalyst
b:$MH/CH_3X$
M = alkaline metal
X = halogen a':propylene oxide
b':$MH/CH_3X$ a":$CH_3MgX$
b":$MH/CH_3X$ The invention will now be described in greater detail in the following examples in which the abbreviations have the usual meaning in the art. The NMR-values (chemical shift δ) are given in ppm relative to TMS as internal standard.

EMBODIMENTS OF THE INVENTION

Example 1

Synthesis of 1-methoxy-2-methyl-3-phenylpropane a) 1-hydroxy-2-methyl-3-phenylpropane 19 g (0.133 mole) of methylcinnamic aldehyde were dissolved in 200 ml of methanol and hydrogenated at room temperature and atmospheric pressure in the presence of 3 g of Raney-nickel. After 4 hours and an absorption of about 71 (0.28 mole) of hydrogen, the reaction was stopped. After filtration and concentration of the solution obtained, the crude product was distilled in a bulb-to-bulb apparatus, at 150° C. ($1\times10^2$ Pa).

19.3 g of a colorless oil, corresponding to a yield of 99%, were obtained.

Odor: balsamic, warm, cinnamon $^1$H-NMR: 0.91(d, J=7.6 Hz, 3H); 1.93(m, 1H); 2.4(m, 1H); 2.75(m, 1H); 3.48(m, 2H); 7.23(m, 5H)

MS: 150(23, $M^+$), 132(27), 117(55), 91(100), 65(16), 39(20)

b) 1-methoxy-2-methyl-3-phenylpropane 220 ml (1.9 mole) of KH (35% in oil) were placed, under a $N_2$-atmosphere, into a 4.5 l reactor and washed 4 times with pentane, in order to remove all traces of oil. 1.5 l of dry tetrahydrofurane were added before the dropwise addition of a solution of 259 g (1.73 mole) of 1-hydroxy-2-methyl-3-phenylpropane and 500 ml of dry tetrahydrofurane. The reaction was stirred for 15 hours at room temperature. Then 285 g (2.01 mole) of methyl iodide were added dropwise over a period of 2 hours, and stirring was continued at room temperature for another 2 hours. A possible excess of KH was hydrolyzed by adding 50 ml of methanol, then the reaction mixture was poured on ice. The product was taken up in ether, which was washed 3 times with a saturated $NH_4Cl$ solution and then with brine to neutrality. After drying over $Na_2SO_4$, the solution was filtered, concentrated and then distilled over a Vigreux-type column (boiling point: 100° C. at $5\times10^2$ Pa).

There were obtained 265.4 g of a colorless oil, corresponding to a yield of 96%.

IR: 2930, 1600, 1495, 1460, 1390, 1190, 1110, 970 $cm^{-1}$ $^1$H-NMR: 0.88(d, J=7.6 Hz, 3H); 2.02(m, 1H); 2.39(dd, J=8 and 16 Hz, 1H); 2.76(dd, J=8 and 16 Hz, 1H); 3.02(m, 2H); 3.33(s, 3H); 7.21(m, 5H)

$^{13}$C-NMR: 140.7(s); 129.2(d); 128.2(d); 125.8(d); 77.5(t); 58.7(q); 39.9(t); 35.4(d); 16.8(q)

MS: 164(4, $M^+$), 132(64), 117(100), 91(89), 65(18), 45(37)

Example 2

Synthesis of 1-(2-methoxypropyl)-4-methylbenzene a) 1-(2-hydroxypropyl)-4-methylbenzene

A solution of toluyl magnesium bromide in ether was prepared from 400 g of brometoluene and 63 g of magnesium in a 2.5 l reactor. To the thus-prepared compound, there were added 150 g of propylene oxide over a period of 20 minutes and at room temperature. The reaction mixture was stirred for 1 hour and then hydrolyzed with one liter of 4M aqueous HCl. The product was extracted with ether, the organic phase washed several times with water to neutrality and then dried over $MgSO_4$. The ether was removed and the crude product distilled over a column to give 320 g of the desired alcohol (91%).

$^1$H-NMR: 1.23(d, J=6 Hz, 3H); 1.61(s, 0H); 2.32(s, 3H); 2.64(dd, J=13 and 8 Hz, 1H); 2.74(dd, J=13 and 5 Hz); 3.97(m, 1H); 7.10(m, 4H)

$^{13}$C-NMR: 21.01(q); 22.73(q); 45.36(t); 68.89(d); 129.24 (2d); 129.29(2d); 135.42(s); 135.96(s)

MS: 150(9, $M^+$), 135(4), 117(4), 115(5), 106(100), 91(74), 79(8), 77(12), 45(7).

b) 1-(2-methoxypropyl)-4-methylbenzene 190 g of 1-(2-hydroxypropyl)-4-methylbenzene were added dropwise to a suspension of 51 g of sodium hydride (60% in mineral oil) in 400 ml of THF, in a 2.5 l flask. The temperature was maintained at about 0° C. with an ice bath.

After one hour, a solution of 270 g of methyl iodide in 200 ml of THF was added, and the solution was stirred for another hour at room temperature after the addition was finished. The mixture was hydrolyzed with a 4M aqueous solution of HCl. The product was then extracted with ether and the organic phase was washed to neutrality with water. After drying, the ether was removed and the crude product distilled under vacuo (about 90° C. at $14\times10^2$ Pa), to obtain 173 g (83%) of pure product.

$^1$H-NMR: 1.10(d, J=5, 3H); 2.30(s, 3H); 2.56(dd, J=14 and 7 Hz, 1H); 2.88(dd, J=14 and 6 Hz, 1H); 3.32(s, 3H); 3.50(m); 7.08(s, 4H)

$^{13}$C-NMR: 18.87(q); 21.00(q); 42.28(t); 56.22(q); 78.17 (d); 128.94(d); 129.29(d); 135.49(s); 135.90(s)

MS: 164(12, $M^+$), 149(2), 133(2), 117(5), 115(6), 106 (21), 105(28), 91(10), 77(12), 59(100).

Example 3

Synthesis of 3-methoxy-2,2,3-trimethyl-1-phenylbutane a) 2,3,3-trimethyl-4-phenyl-2-butanol

A solution of methyl magnesium iodide was prepared from 21.7 g of methyl iodide, 3.4 g of magnesium and 80 ml of diethyl ether, in a 500 ml three-necked flask equipped with a reflux condenser, a thermometer and a dropping funnel and under a nitrogen atmosphere. A solution of 3,3-dimethyl-4-phenyl-2-butanone (prepared as described in patent application DE 3210725) in 70 ml of diethyl ether was added dropwise under reflux. The resulting reaction mixture was stirred for 1 night at room temperature, then poured onto ice, taken up in ether, washed with an aqueous $NH_4Cl$ solution to neutrality and dried over $Na_2SO_4$. The ether was then removed under vacuo and the crude product distilled over a Vigreux type column at 41–55°/$1.2\times10^1$ Pa, to obtain 17.0 g (62%) of the desired product.

IR: 3464, 2973, 1496, 1375, 1128, 1099 $cm^{-1}$ $^1$H-NMR: 0.84(s, 6H), 1.29(s, 6H), 2.68(s, 2H), 7.11–7.30 (m, 5H)

$^{13}$C-NMR: 139.6(s), 131.1(2d), 127.6(d), 125.8(d), 76.7 (s), 42.3(t), 41.2(s), 25.53(q), 25.48(q), 21.4(2q)

MS: 192(0, $M^+$), 134(26), 91(52), 59(100), 43(18).

b) 3-methoxy-2,2,3-trimethyl-1-phenylbutane

This compound was prepared, in an analogous way to that described under 1b), from the above-obtained alcohol (12 g, 0.048 mole), 10.4 ml of a 20% suspension of KH in oil (0.06 mole) and 8.74 g (0.062 mol) of methyl iodide, and a total of 70 ml THF. There were obtained 10.1 g of a product having a boiling point of 56°/$1.2\times10^1$ Pa. In order to obtain a pure product (purity 99%), the product obtained from the distillation step can be subjected to chromatography over a $SiO_2$-column using a mixture of cyclohexane/diethyl ether as eluent.

IR: 2973, 2824, 1472, 1364, 1153, 1075 $cm^{-1}$ $^1$H-NMR: 0.79(s, 6H), 1.18(s, 6H), 2.68(s, 2H), 3.23(s, 3H), 7.11–7.30(m, 5H)

$^{13}$C-NMR: 140.2(s), 131.3(2d), 127.4(2d), 79(s), 49.4(q), 42(t), 41.7(s), 21.5(2q), 19.3(2q)

MS: 206(0, $M^+$), 91(20), 73(100), 43(12).

Example 4

Stability Test of 1-methoxy-2-methyl-3-phenylpropane and 1-(2-methoxypropyl)-4-methylbenzene in Chlorine Bleach The above-mentioned compounds were diluted to 0.2% in unperfumed chlorine bleach and stored over 30 days at temperatures of 3°, 22° and 40° C.

The products were then evaluated by a panel of expert perfumers for their olfactive qualities.

The value of the resulting olfactive quality is given in the following table by the letters A to E having the following significations:

A=odor not changed

B=odor slightly modified

C=odor clearly changed

D=odor strongly changed, becomes unpleasant

E=odor totally modified, cannot be recognized

The intensity of the odor is signified on a scale from 1 (lowest) to 10 (highest).

| Product | Temperatures 3° C. | 22° C. | 40° C. |
|---|---|---|---|
| 1-methoxy-2-methyl-3-phenylpropane | A8 | A7 | B6 |
| 1-(2-methoxypropyl)-4-methylbenzene | A8 | A6 | B5 |

The results show that the two compounds of the invention have an excellent stability in bleach. Moreover, the quality and strength of their olfactive notes were found to be excellent in covering the bad odor of chlorine bleach.

Example 5

Perfuming composition of the Ylang type for use in a detergent

| Ingredients | Parts by weight |
|---|---|
| Linalyl acetate | 20 |
| Verdyl acetate | 80 |
| Methyl benzoate | 20 |
| 10% Cetalox ®[1)]* | 10 |
| Citronellol | 120 |
| Dihydromyrcenol | 170 |
| Eugenol | 20 |
| Geraniol | 200 |
| Habanolide ®[2)] | 200 |
| 10% Indol* | 20 |
| Iralia ®[3)] | 100 |
| Phenoxyethyl isobutyrate | 20 |
| Lorysia ®[4)] | 200 |
| Mayol ®[5)] | 30 |
| Methyl-para-cresol | 10 |
| Phenylhexanol | 230 |
| 4-tert-Butyl-1-cyclohexanol | 50 |
| Total | 1500 |

*in dipropylene glycol
[1)]8,12-epoxy-13,14,15,16-tetranorlabdane; origin: Fimenich SA, Geneva, Switzerland
[2)]mixture of 1-oxa-12-cyclohexadecen-2-one and 1-oxa-13-cyclohexadecen-2-one; origin: Firmenich SA, Geneva, Switzerland
[3)]isomer mixture of methylionone; origin: Firmenich SA, Geneva, Switzerland
[4)]mixture of cis-4-(1,1-dimethylethyl)-1-cyclohexyl acetate + trans-4-(1,1-dimethylethyl)-1-cyclohexyl acetate; origin: Firmenich SA, Geneva, Switzerland
[5)]cis-7-p-menthanol; origin: Firmenich SA, Geneva, Switzerland The addition of 50 parts of 1-methoxy-2-methyl-3-phenylpropane to this base composition of the floral type conferred to it a softer and more sophisticated note. Moreover, it was observed that the medicinal aspect imparted by the methyl-para-cresol is covered by a nice rosy-fruity olfactive touch, slightly green and quite perceptible.

Example 6

Perfuming composition for use in bleach

| Ingredients | Parts by weight |
|---|---|
| Camphor | 150 |
| Dodecanitrile | 80 |
| Dihydroterpineol | 70 |
| Diphenyloxide | 600 |
| Eucalyptol | 450 |
| 3,7-Dimethyl-3-octanol[2)] | 750 |
| Total | 2100 |

-continued

Perfuming composition for use in bleach

| Ingredients | Parts by weight |
|---|---|

[1)]dodecane nitrile; origin: International Flavours & Fragrances, USA
[2)]origin: Firmenich SA, Geneva, Switzerland When there were added to this base composition, typical for a bleach product, 16% by weight of 1-methoxy-2-methyl-3-phenylpropane, it was found that its odor had acquired a superb floral, rose-type character which was very natural. One could also notice that the medicinal effect conferred by the eucalyptus and the metallic note of the diphenyloxide were abated, such that the odor of the composition became softer, the compound of the invention imparting a pleasant fruity connotation to the composition.

What we claim is:

1. A method to improve, enhance or modify the odor of a perfuming composition or a perfumed article, which method comprises adding to said composition or article an effective amount of 1-(2-methoxy-propyl)-4-methylbenzene or 3-methoxy-2,2,3-trimethyl-1-phenylbutane.

2. Perfuming composition or perfumed article containing as a perfuming ingredient 1-(2-methoxy-propyl)-4-methylbenzene or 3-methoxy-2,2,3-trimethyl-1-phenylbutane.

3. Perfumed article according to claim 2, in the form of a perfume or cologne, a soap, a bath or shower gel, a shampoo or other hair care product, a cosmetic preparation, a body deodorant or an air freshener, a detergent or a fabric softener, or an all-purpose cleaner.

4. Chlorinated product containing as perfuming ingredient 1-methoxy-2-methyl-3-phenylpropane, 1-(2-methoxy-propyl)-4-methylbenzene or 3-methoxy-2,2,3-trimethyl-1-phenylbutane.

5. Chlorinated product according to claim 4, in the form of a detergent containing perfume aggressive substances or having a high pH value.

6. Chlorinated product according to claim 4, in the form of a chlorine bleach.

7. 1-(2-Methoxypropyl)-4-methylbenzene.

8. 3-Methoxy-2,2,3-trimethyl-1-phenylbutane.

9. A method to improve, enhance or modify the odor of a perfuming composition or a perfumed article, which method comprises adding to said composition or article an effective amount of 1-methoxy-2-methyl-3-phenylpropane in admixture with one of a solvent or perfume adjuvant to provide the desired perfume characteristics to the composition or article.

10. Perfuming composition or perfumed article containing as a perfuming ingredient 1-methoxy-2-methyl-3-phenylpropane in admixture with one of a solvent or perfume adjuvant to provide the desired perfume characteristics to the composition or article.

11. Perfumed article according to claim 10, in the form of a perfume or cologne, a soap, a bath or shower gel, a shampoo or other hair care product, a cosmetic preparation, a body deodorant or an air freshener, a detergent or fabric softener, or an all-purpose cleaner.

* * * * *